US005630323A

United States Patent [19]

Niijima et al.

[11] Patent Number: 5,630,323

[45] Date of Patent: May 20, 1997

[54] REFRIGERATING APPARATUS

[75] Inventors: Hirosi Niijima, Ouragun Gunmaken; Takeshi Kawaguchi, Ootashi Gunmaken; Hisao Sagara, Ouragun Gunmaken; Zenichi Kakinuma, Sanoshi Tochigiken; Yoshirou Ishizaka, Ouragun Gunmaken, all of Japan

[73] Assignee: Sanyo Electric Co., Ltd., Osakafu, Japan

[21] Appl. No.: 500,736

[22] Filed: Jul. 11, 1995

[30] Foreign Application Priority Data

Jul. 15, 1994 [JP] Japan ..... 6-164228

[51] Int. Cl.[6] ..... F25B 1/00; G05D 23/32

[52] U.S. Cl. ..... 62/158; 62/228.1; 62/498

[58] Field of Search ..... 62/158, 498, 190, 62/115, 228.1

[56] References Cited

U.S. PATENT DOCUMENTS 4,873,836 10/1989 Thompson ..... 62/158

5,309,728 5/1994 Chae ..... 62/158

FOREIGN PATENT DOCUMENTS 61-2447 1/1986 Japan .

4124567 4/1992 Japan ..... 62/488

*Primary Examiner*—William E. Wayner

*Attorney, Agent, or Firm*—Darby & Darby

[57] ABSTRACT

A refrigerating apparatus capable of reducing the start noise of the compressor comprises a compressor 1, a condenser 2, a capillary tube 4, and an evaporator 6, serially connected by piping to form a closed loop. The apparatus further comprises a solenoid valve 3 installed between the outlet of the condenser 2 and the capillary tube 4 and a control unit C controlling the compressor 1 and the solenoid valve 3. The control unit opens and closes the solenoid valve 3 in response to the operation and stop of the compressor 1 and in particular closes the solenoid valve 3 before the compressor 1 stops.

2 Claims, 7 Drawing Sheets

REFRIGERATING APPARATUS

BACKGROUND OF THE INVENTION

1. Field of the Invention

The present invention relates to the refrigerating apparatus used in a refrigerated showcase, a refrigerator, an air conditioner, or the like.

2. Description of the Prior Art

This type of conventional refrigerating apparatuses such as the device for air conditioners disclosed in Japanese Utility Model Publication No. (sho) 61-2447 (F25B 1/00), comprise a compressor, a condenser, an expansion device, and an evaporator, serially connected by piping to form a closed loop. The apparatus condenses the refrigerant discharged from the compressor in the condenser, expands it in the expansion device, and introduces it into the evaporator where it evaporates, thereby cooling the interior of a refrigerated showcase, for example.

FIG. 8 illustrates the refrigerant circuit of the refrigerating apparatus 100 of a conventional refrigerated showcase. FIG. 8 shows a rotary type compressor 1, a condenser 2 connected by piping to the discharge side 1D of the compressor 1, and a solenoid valve 3 connected to the outlet side of the condenser 2. FIG. 8 further shows a capillary tube 4, which is used as an expansion device, connected to the outlet side of the solenoid valve 3, an evaporator 6 connected to the outlet side of the capillary tube 4, and a check valve 7 connected by piping between the outlet side of the evaporator 6 and the suction inlet side 1S of the compressor 1. The positive direction of the check valve 7 is the same as the operating direction of the compressor 1.

In the above construction, when the interior temperature of a refrigerated showcase (not shown) rises to the preset upper limit, a control device which includes a thermostat (not shown) starts the compressor 1. The solenoid valve 3 is opened simultaneously with the start of the compressor 1. Then the gas refrigerant which is under high pressure and temperature is discharged from the discharge side 1D of the compressor 1 and flows into the condenser 2 where the gas refrigerant loses its heat and condenses into liquid. The liquid refrigerant from the outlet of the condenser 2 flows through the solenoid valve 3 and through the capillary tube 4, where its pressure is lowered, and finally flows into the evaporator 6. The refrigerant introduced into the evaporator 6 evaporates and cools the air surrounding the evaporator by taking heat away from its immediate surroundings. The gas refrigerant from the outlet of the evaporator 6 flows through the check valve 7 and is sucked into the compressor 1 at the suction side 1S of the compressor 1.

The cooled air refrigerated in the evaporator 6 is circulated to the interior of the refrigerated showcase and thereby refrigerates it. When the interior temperature falls to the preset lower limit of such refrigerating operation, the control device stops the compressor 1 and simultaneously closes the solenoid valve 3 to stop the refrigerating operation.

When the compressor 1 stops, the flow of the liquid refrigerant from the condenser 2 through the capillary tube 4 to the evaporator 6 is prevented by this closing of the solenoid valve 3. The refrigerant is prevented from flowing back from the suction side 1S of the rotary type compressor 1 to the evaporator 6 by the check valve 7. Thus, the pressure difference between the high pressure side and the low pressure side remains when the compressor 1 stops.

Recently, reducing the noise generated by the compressor in such refrigerated showcases has become a problem as the standard of living improves. Noise reduction is especially important for showcases used in shops integrated with houses.

In the conventional refrigerating device 100, the pressure difference between the high pressure side and the low pressure side remains when the compressor stops. Since the refrigerant remains in the evaporator 6, the pressure of the refrigerant rises when the compressor 1 is not running. The pressure at the suction side 1S of the compressor is thus high when the compressor is started again. In the conventional refrigerating apparatus, the high pressure at the suction side 1S of the compressor 1 increases the required torque needed to start the compressor and thereby creates excessive loads on the bearings, and causing a relatively loud noise similar to the sound of a buzzer for a relatively long time period from t1 (start) to t2, as shown in FIG. 9.

SUMMARY OF THE INVENTION

The purpose of the invention is to solve the above-described problems and to provide a refrigerating apparatus capable of substantially reducing the noise when the compressor starts.

The refrigerating apparatus of the invention comprises a compressor, a condenser, an expansion device, and an evaporator, serially connected by piping to form a closed loop. The apparatus further comprises a valve installed between the outlet of the condenser and the inlet of the expansion device in addition to a control unit controlling both the compressor and the valve. The control unit opens and closes the valve in response to the operation and stop of the compressor. Particularly, the control unit closes the valve before the compressor stops. The apparatus further comprises a valve installed between the compressor and the evaporator for preventing the refrigerant from flowing back from the compressor to the evaporator when the compressor stops.

Further, the refrigerating apparatus comprises a compressor, a condenser, an expansion device, and an evaporator, serially connected by piping to form a closed loop. The apparatus further comprises a valve installed between the outlet of the condenser and the inlet of the expansion device in addition to a control unit controlling the compressor and the valve. The control unit opens and closes the valve in response to the operation and stopping of the compressor. Particularly, the control unit opens the valve after the compressor starts and closes the valve before the compressor stops. The apparatus further comprises a valve installed between the compressor and the evaporator for preventing the refrigerant from flowing back from the compressor to the evaporator when the compressor stops.

In the refrigerating apparatus of the invention, since the apparatus is designed so that the valve is opened and closed in response to the operation and stopping of the compressor and in particular the valve is closed before the compressor stops, it is possible to perform a so-called pump down operation whereby the refrigerant in the evaporator is reclaimed into the condenser by operating the compressor while the valve is closed before stopping the compressor. The valve also blocks the refrigerant from flowing into the evaporator from the condenser when the compressor is stopped. Thus it is possible to reduce the pressure rise at the low pressure side upon stopping of the compressor to a minimum, thereby relieving the load when the compressor starts again, and thereby substantially reducing the generated noise.

Further, in the refrigerating apparatus of the invention, since the apparatus is designed so that the valve is opened and closed in response to the operation and stopping of the compressor and in particular the valve is opened after the compressor starts and closed before the compressor stops, it is possible to perform the so-called pump down operation whereby the refrigerant in the evaporator is reclaimed into the condenser by operating the compressor while the valve is closed before stopping the compressor. The valve also blocks the refrigerant from flowing into the evaporator from the condenser when the compressor is stopped. Also, it is possible to substantially reduce the amount of refrigerant at the suction side when the compressor starts and to operate the compressor under a light load. Thus, it is possible to substantially relieve the load when the compressor starts again, and to substantially reduce the generated noise.

BRIEF DESCRIPTION OF THE DRAWINGS

The invention is described below in detail with references to the accompanying drawings where.

DESCRIPTION OF THE EMBODIMENTS

Figure 1:
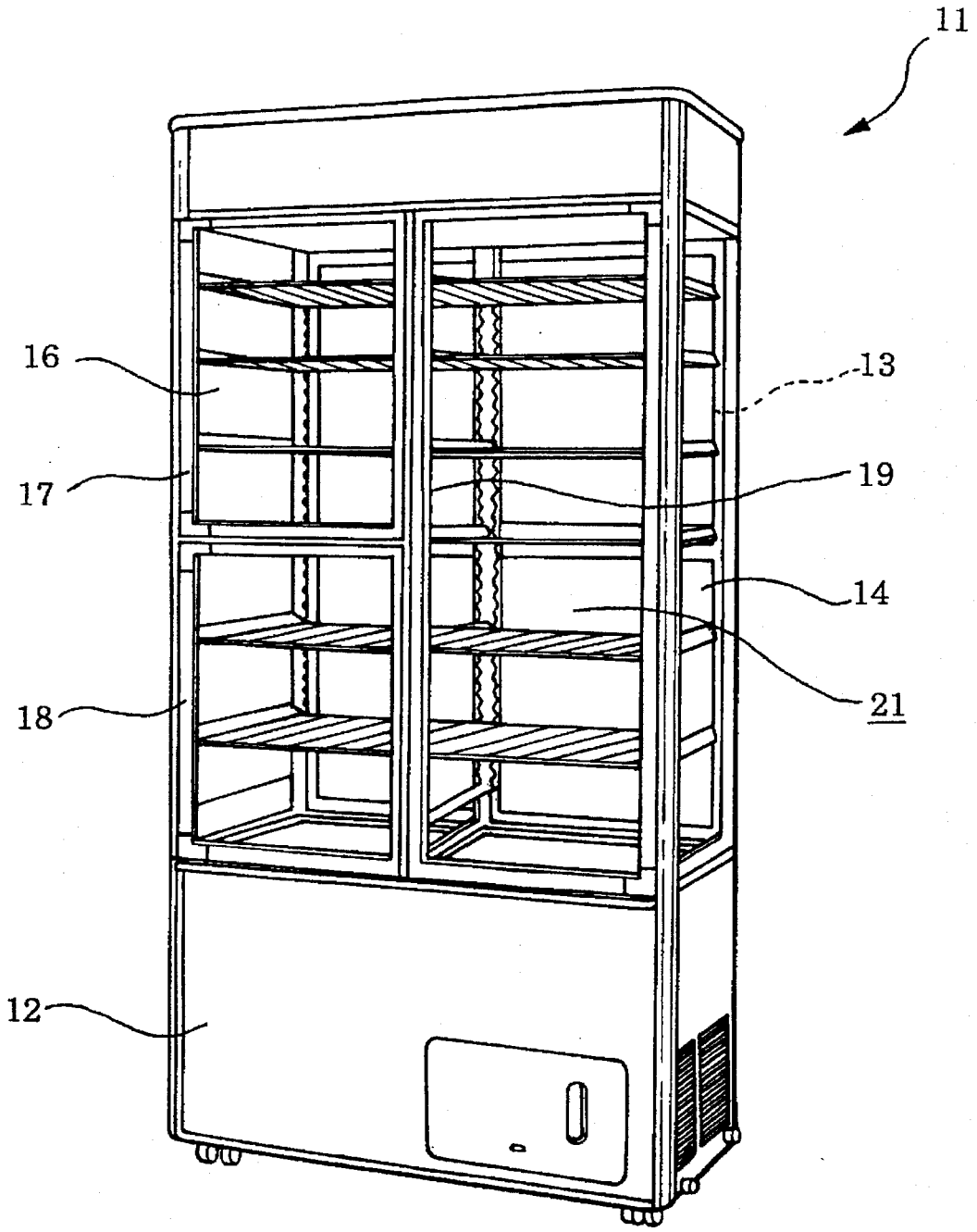
FIG. 1 is a perspective view showing a refrigerated showcase with a refrigerating apparatus according to the invention.
Figure 2:
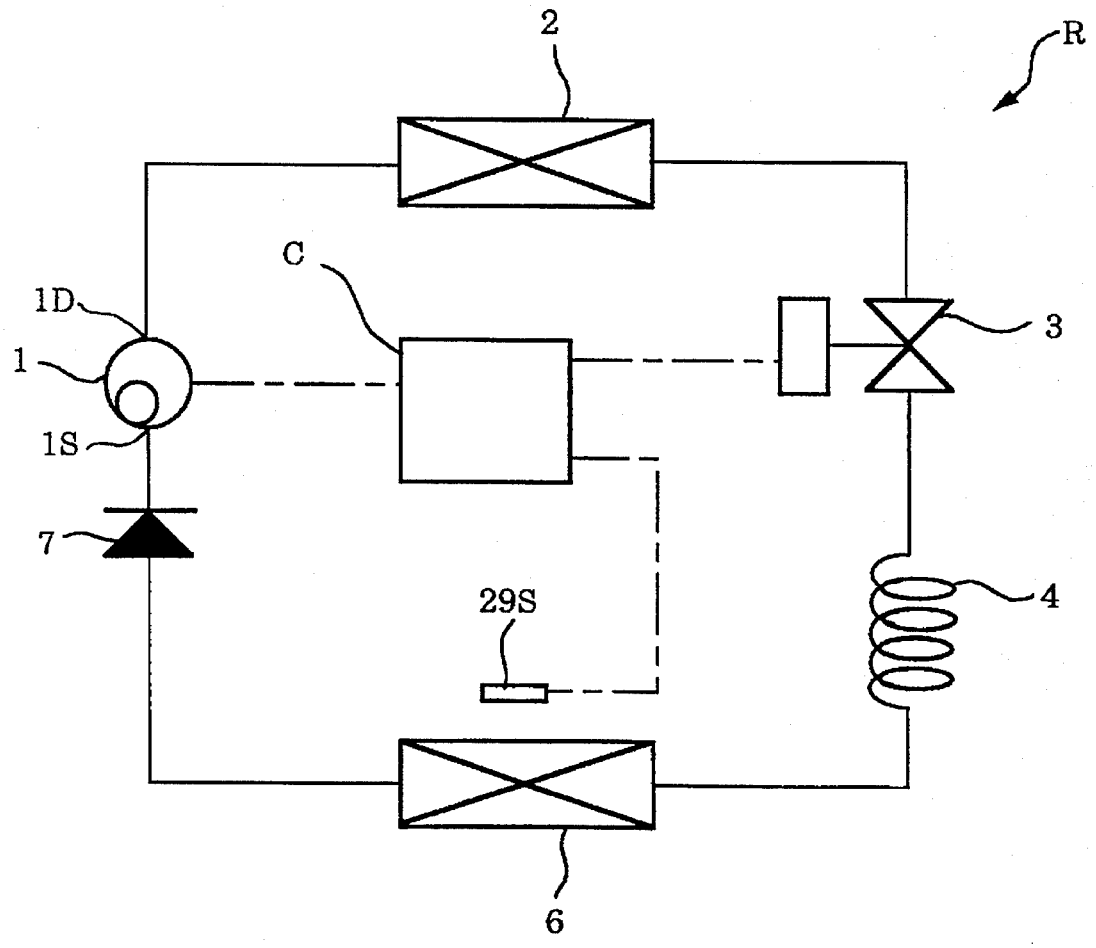
FIG. 2 is a refrigerant circuit diagram of the refrigerating apparatus according to the invention.
Figure 3:
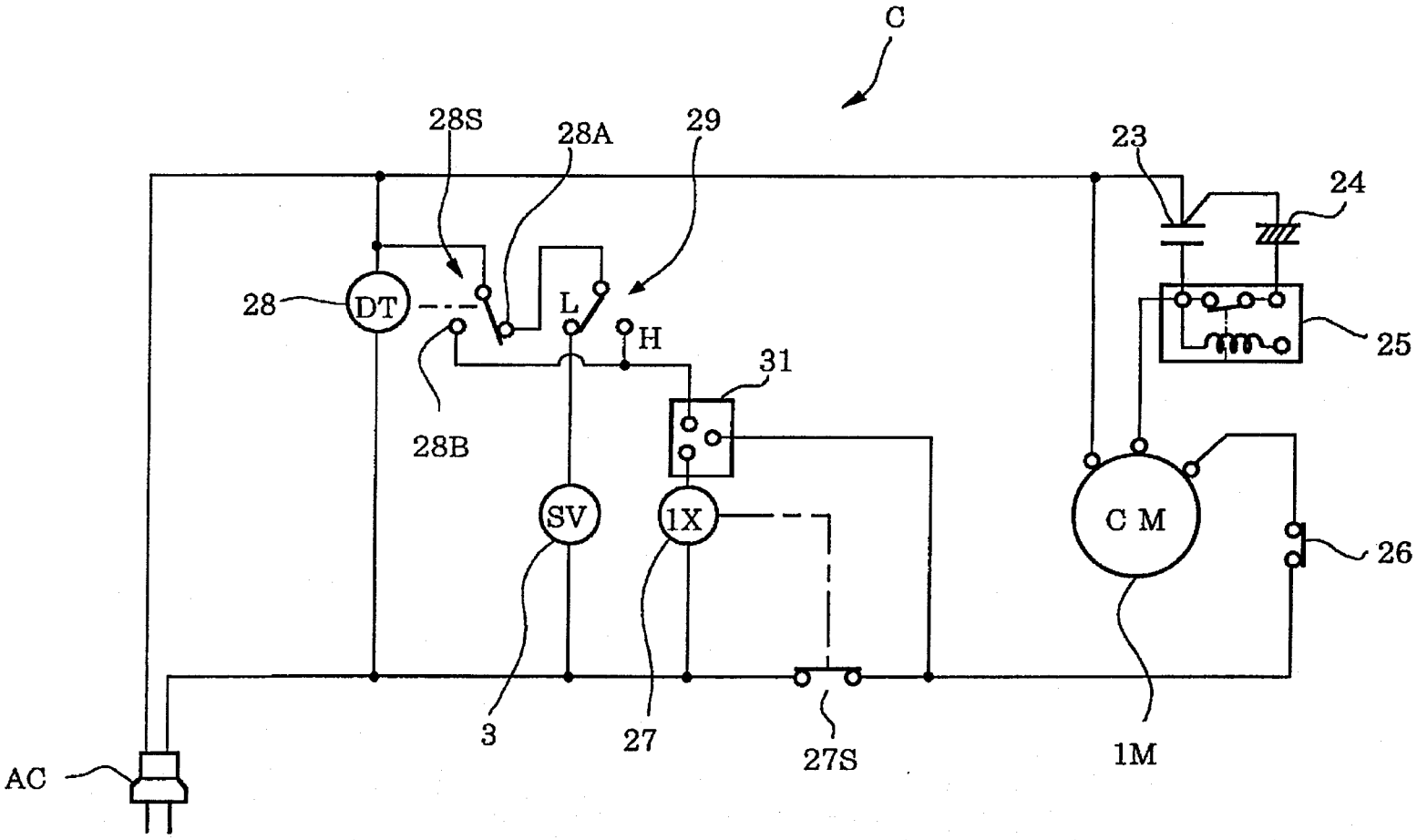
FIG. 3 is an electric circuit diagram of a control unit of the refrigerating apparatus according to the invention.
Figure 8:
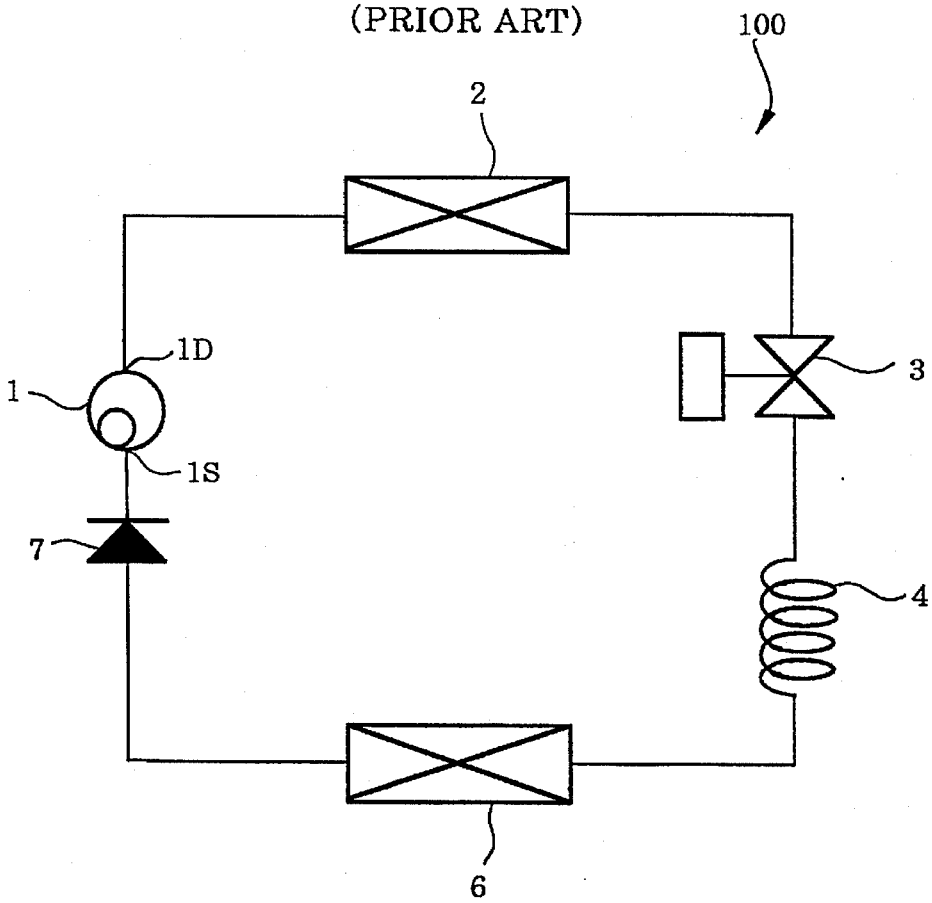
FIG. 8 (PRIOR ART)
FIG. 8 is a refrigerant circuit diagram of a conventional refrigerating apparatus.
Figure 9:
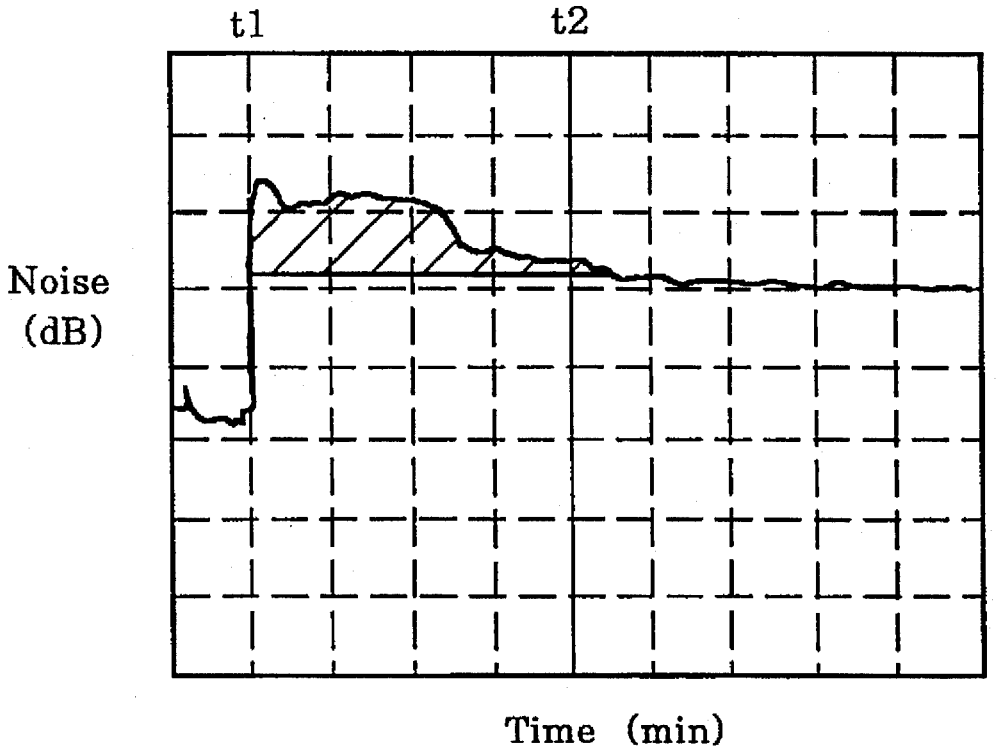
FIG. 9 (PRIOR ART)
FIG. 9 is a graph showing the compressor noise level of a conventional refrigerating apparatus.

FIG. 1 illustrates a perspective view of a refrigerated showcase 11 with a refrigerating apparatus R as an embodiment of the present invention. FIG. 2 illustrates the refrigerant circuit of the refrigerating apparatus R. FIG. 3 illustrates the electric circuit of a control unit C of the refrigerating apparatus R. In these drawings, the same reference numerals are used for the elements which are the same as those in FIG. 8 and FIG. 9.

In FIG. 1, the refrigerated showcase 11 is composed of a mechanical compartment 12 positioned at the lower part of the showcase, and a storage room 21 positioned over the mechanical compartment 12 and surrounded by a rear wall 13, side walls 14, 16 and front doors 17 to 19. The side walls 14, 16 and the front doors 17 to 19 are made of transparent glass.

In FIG. 2, which is the refrigerant circuit diagram of the refrigerating apparatus R, shown are a rotary compressor 1, a condenser 2 connected by piping to the discharge side 1D of the compressor 1, and a solenoid valve 3 connected as a valve to the outlet of the condenser 2. Also shown are a capillary tube 4 which is used as an expansion device connected to the outlet of the solenoid valve 3, an evaporator 6 connected to the outlet of the capillary tube 4, and a check valve 7 connected by piping between the outlet of the evaporator 6 and the suction inlet side 1S of the compressor 1. The positive direction of the check valve 7 is the same as the operating direction of the compressor 1. The evaporator 6 together with a blower (not shown) is installed in a cooling chamber (also not shown) which is positioned below and communicates with the storage area 21 of the refrigerated showcase 11.

In FIG. 3, which is the electric circuit diagram of the control unit C, shown is a motor 1M of the compressor 1 connected to an AC outlet through an operation capacitor 23, a start capacitor 24, a power relay 25, and a start relay 26. Further shown are a normally-closed contact 27S of an auxiliary relay (1×) 27 positioned between the start relay (26) and the AC outlet in addition to a defrosting timer (DT) 28 connected to the AC outlet. The defrosting timer has a selection switch 28S which has a normally closed contact 28A connected to a common contact of a thermostat 29.

The solenoid valve 3 is connected between an L terminal of the thermostat 29 and the AC outlet. An H terminal of the thermostat 29 and a normally-open contact 28B of the selection switch 28S are connected to a delay timer 31. The auxiliary relay 27 is connected between the delay timer 31 and the AC outlet. The delay timer 31 is designed to energize the auxiliary relay 27 after a time delay, for example 30 seconds from the energizing of the delay timer. The defrosting timer 28 is designed to close the selection switch 28S to the normally-open contact 28B at a specified time interval, for example, every 12 hours. A temperature sensor 29S (refer to FIG. 2) of the thermostat 29 is positioned near the evaporator 6 to detect the temperature in the storage area 21. The thermostat 29 is designed to be closed to contact the L terminal if the temperature in the storage area 21 rises to the upper limit (for example, +5° C.) and to be closed to contact the H terminal if the temperature falls to the lower limit (for example, +1° C.).

Figure 4:
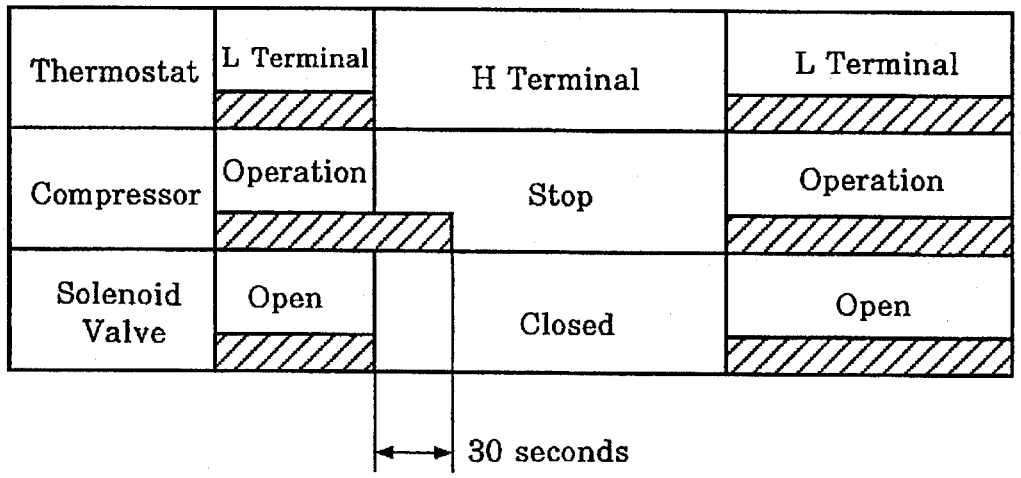
FIG. 4 is a timing chart explaining the operation of the refrigerating apparatus according to the invention.

The operation of the refrigerating apparatus R of the present invention having the above-described construction is explained below by referring to the timing chart of FIG. 4. The motor 1M of the compressor 1 is stopped when the thermostat 29 is closed to contact the H terminal since the auxiliary relay 27 is energized to open the normally-closed contact 27S. In addition, the solenoid valve 3 is closed since it is not energized. In this state, if the temperature in the storage area 21 rises to +5° C., the thermostat 29 is closed to contact the L terminal thereby deenergizing the auxiliary relay 27, which in turn closes the normally-closed contact 27S and starts the motor 1M. Simultaneously, the solenoid valve 3 is energized and thus opens.

When the motor 1M starts, the gas refrigerant under high pressure and temperature discharges from the discharge side 1D of the compressor 1 and flows into the condenser 2 where the gas refrigerant loses its heat and condenses into liquid. The liquid refrigerant from the outlet of the condenser 2 flows through the solenoid valve 3 and through the capillary tube 4, where its pressure is lowered, and finally into the evaporator 6. The refrigerant introduced into the evaporator 6 evaporates and cools the air surrounding the evaporator by taking heat away from is immediate surroundings. The gas refrigerant from the outlet of the evaporator 6 flows through the check valve 7 and is sucked into the compressor 1 at the suction side 1S of the compressor 1.

The cooled air refrigerated in the evaporator 6 is circulated to the storage area 21 by the blower in order to cool the interior of the storage area 21. If the temperature in the storage area 21 falls to +1° C. (the lower limit) in this cooling operation, the thermostat 29 is closed to contact the H terminal and thus, first, the solenoid valve 3 is deenergized and closed. The delay timer 31 is energized, which in turn energizes the auxiliary relay 27, 30 seconds after the time of closing the solenoid valve 3 to open the normally-closed contact 27S, thus stopping the motor 1M of the compressor 1. If the temperature in the storage area 21 rises above +5° C. again, the thermostat 29 is closed to contact the L terminal to open the solenoid valve 3, and the motor 1M of the compressor 1 starts. Accordingly, the interior of the storage area 21 is kept at an average +3° C.

Since the defrosting timer 28 closes the selection switch to the normally-open contact 28B after 12 hours from the start of the operation, the solenoid valve 3 is first deenergized and closed and simultaneously the delay timer 31 is energized, which in turn energizes the auxiliary relay 27, 30 seconds after the closing of the solenoid valve 3 to open the normally-closed contact 27S, and thus stop the motor 1M of the compressor 1. A defrosting heater, etc. (not shown) can be energized to defrost the evaporator 6. Off-cycle defrosting may also be performed. Since the selection switch 28S is again closed to contact the normally-closed contact 28A after completing the defrosting, the solenoid valve 3 and the motor 1M are again energized. Thus, the solenoid valve 3 opens and the motor 1M starts.

In this way, when the compressor 1 stops, the solenoid valve 3 first closes and then the motor 1M of the compressor 1 stops after 30 seconds. Therefore, during this 30 seconds period, the refrigerant that remains in the evaporator 6 is sucked into the compressor 1 and reclaimed into the condenser 2. That is, according to the present invention, whenever the compressor 1 stops, a pump-down operation is performed and the pressure in the evaporator 6 falls below 3 kg/cm$^2$, for example. In addition, since the solenoid valve 3 is closed when the compressor 1 stops, that is, when the thermostat 29 is closed to contact the H terminal, refrigerant inflow from the condenser 2 through the capillary tube 4 to the evaporator 6 is blocked. Due to the check valve 7, the reverse flow of the refrigerant from the suction side 1S of the compressor 1 to the evaporator 6 is also blocked.

Figure 5:
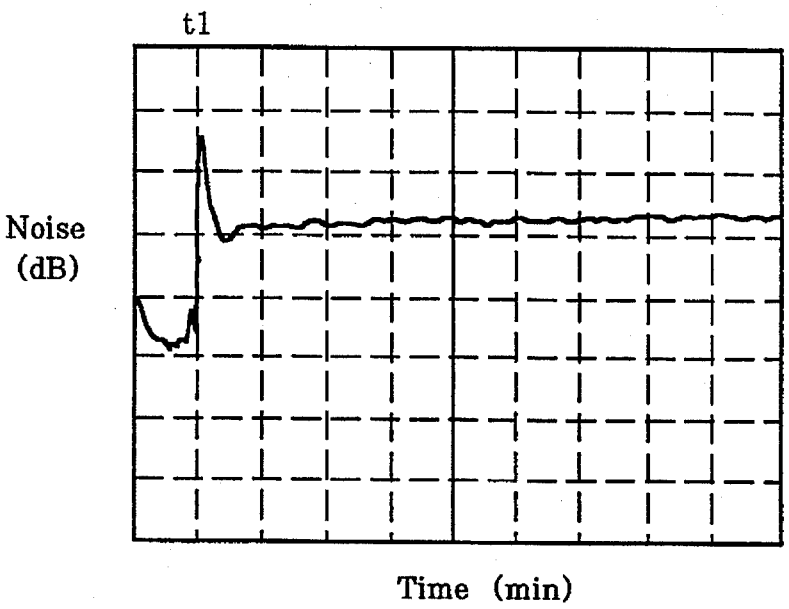
FIG. 5 is a graph showing the compressor noise level of the refrigerating apparatus according to the invention.

Therefore, it is possible to hold the pressure rise at the low pressure side of the compressor 1 to a minimum during the stopping of the compressor and to relieve the load when the compressor 1 starts again. FIG. 5 illustrates the noise level of the compressor 1. In this Figure, the noise level rises temporarily at t1, the start time of the compressor 1, but soon drops because the start load is relieved as described above. Thus, compared to the noise generated by a conventional apparatus shown in FIG. 9, the noise can be substantially reduced.

In addition, the delay time of the delay timer 31 is not limited to 30 seconds. The optimum value can be selected depending on the capacity (internal volume) or the evaporating temperature of the evaporator 6 and the displacement volume of the compressor 1. The optimum time may be chosen to be the time for the pressure in the evaporator 6 to drop to about 3 kg/cm$^2$ by the above-described pump-down operation. Tests resulted in preferable times range from 10 seconds to 1 minute for the refrigerated showcase 11. As described above, a delay time of 30 seconds was most preferred as the value for almost all refrigerated showcases 11.

Figure 6:
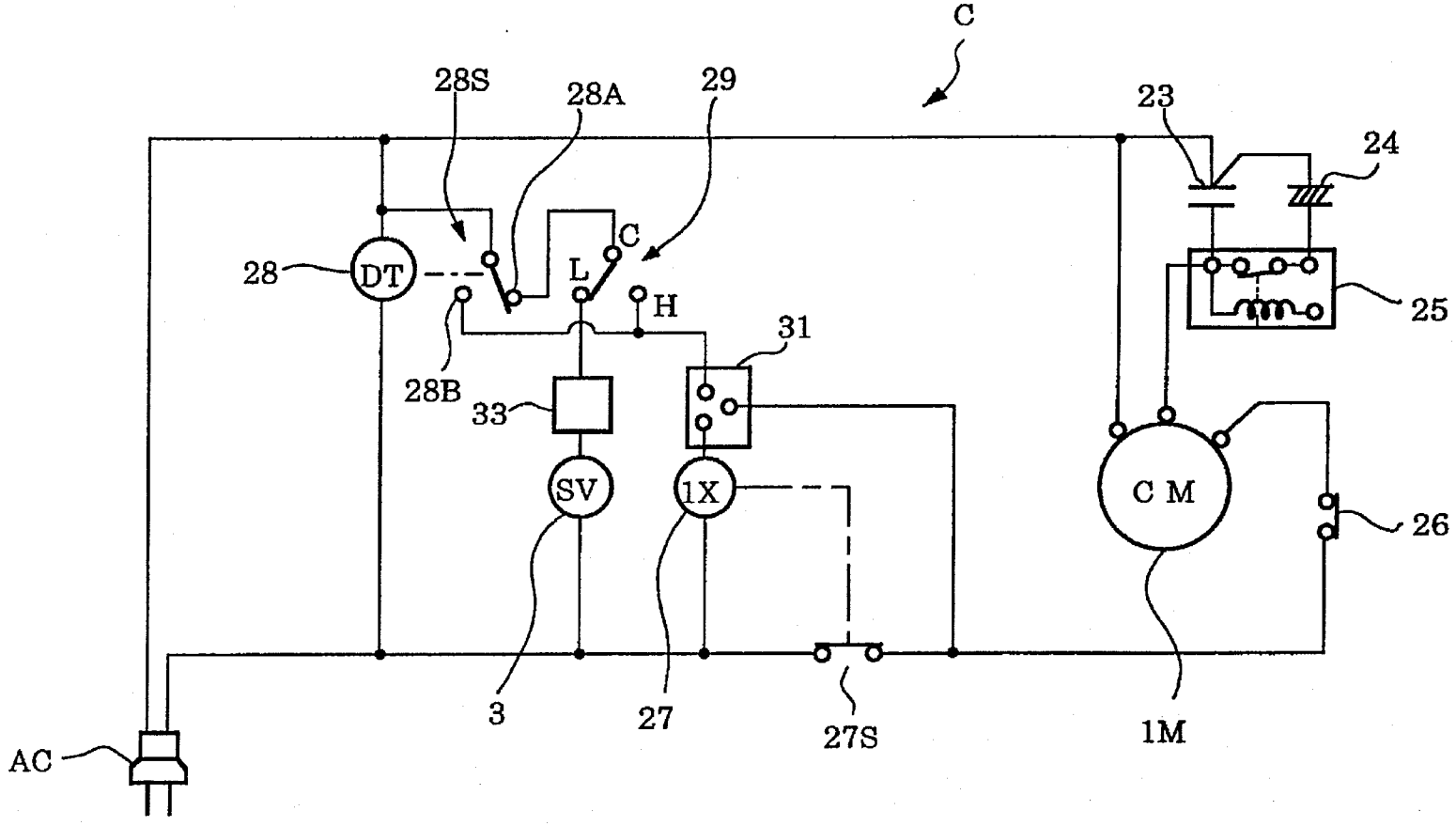
FIG. 6 is the electric circuit diagram of an alternate control unit of the refrigerating apparatus according to the invention.
Figure 7:
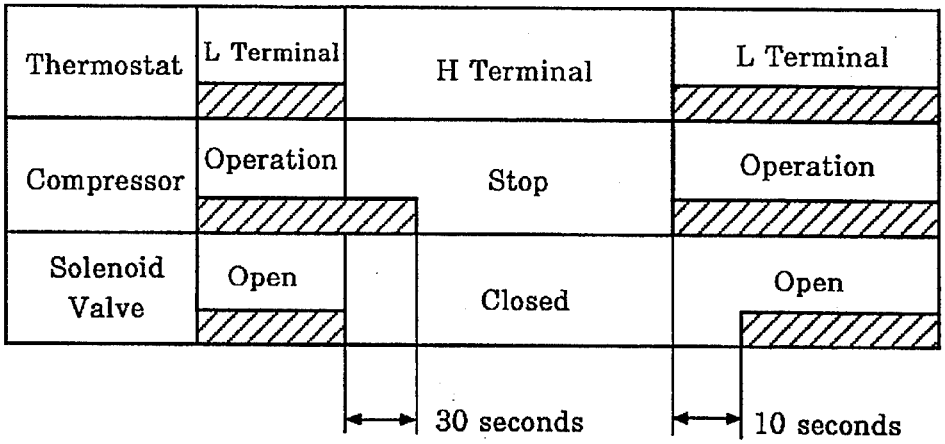
FIG. 7 is a timing chart explaining the operation of the refrigerating apparatus with the control unit of FIG. 6.

FIG. 6 shows an electric circuit diagram for an alternate control unit C for the refrigerating apparatus R. The same reference numerals indicate same parts in FIG. 6 and FIG. 3. The difference from FIG. 3 is that a delay timer 33 is connected in series with the solenoid valve 3. The delay timer 33 energizes the solenoid valve 3 10 seconds after the delay timer is energized. Thus, if the temperature in the storage area 21 rises to +5° C. and the thermostat 29 is closed to contact the L terminal, the auxiliary relay 27 is deenergized, the normally-closed terminal 27S closes, and the motor 1M of the compressor 1 starts. Simultaneously, as illustrated in the timing chart of FIG. 7, 10 seconds after the the motor 1M starts, the solenoid valve 3 is energized and opened. The other operations are the same as those described above and explanations of them are omitted.

During the 10 seconds from the start of the compressor 1 and while the solenoid valve 3 is still closed, there is substantially no suction of the refrigerant at the suction side 1S and it is possible for the compressor 1 to operate under a light load. Therefore, it is possible to reduce the load substantially when the compressor is started again and to substantially reduce the noise generated. Especially in the situation when the compressor 1 is stopped for a long time, the pressure in the evaporator 6 may not be kept low due to minute leakage of refrigerant from the check valve 7 and the solenoid valve 3. Even in such a case, the control unit C in FIG. 6 can effectively reduce the start load of the compressor 1.

Although a delay timer is used to set the delay time in the above embodiment, the present invention is not limited thereto, and it is possible to delay the stopping of the compressor 1 or the opening of the solenoid valve 3 until the pressure drops to a preset value by attaching a pressure sensor to the suction side 1S of the compressor 1. The advantage of using a delay timer as in this embodiment is that the circuit of the control unit C can be manufactured at a cheaper price. Although the embodiment has been explained for a refrigerated showcase, the present invention can be applied to other refrigerating apparatus including refrigerators, air conditioners, etc.

As described above, in the refrigerating apparatus of the invention since the apparatus is designed so that the valve is opened and closed in response to the operation and stop of the compressor and in particular the valve is closed before the compressor stops, it is possible to perform the so-called pump down operation whereby the refrigerant in the evaporator is reclaimed into the condenser by operating the compressor while the valve is closed before stopping the compressor. The valve also blocks the refrigerant from flowing in the evaporator from the condenser when the compressor is stopped. Thus it is possible to keep the pressure rise at the low pressure side during the stop of the compressor to a minimum, thereby relieving the load when the compressor starts again, and thereby substantially reducing the generated noise.

Still further, since the apparatus is designed so that the valve is opened and closed in response to the operation and stopping of the compressor and in particular the valve is opened after the compressor starts and the valve is closed before the compressor stops, it is possible to perform the so-called pump-down operation whereby the refrigerant in the evaporator is reclaimed into the condenser by operating the compressor while the valve is closed before stopping the compressor. The valve also blocks the refrigerant from flowing in the evaporator from the condenser when the compressor is stopped. Also, it is possible to substantially reduce the amount of refrigerant at the suction side when the compressor starts and to operate the compressor under a light load. Thus, it is possible to substantially relieve the load when the compressor starts again, and to substantially reduce the generated noise.

We claim:

1. A refrigerating apparatus comprising:

a compressor, a condenser, an expansion device, and an evaporator, serially connected by piping to form a closed loop;

a first valve located between an outlet of the condenser and the expansion device;

a second valve located between the compressor and the evaporator for preventing the refrigerant from flowing back from the compressor to the evaporator when the compressor stops; and a control unit controlling the compressor and the first valve, said control unit opening and closing the first valve in response to the operation and stopping of the compressor so the closing of the first valve occurs before the compressor is stopped.

2. A refrigerating apparatus comprising:

a compressor, a condenser, an expansion device, and an evaporator, serially connected by piping to form a closed loop;

a first valve located between an outlet of the condenser and the expansion device;

a second valve located between the compressor and the evaporator for preventing the refrigerant from flowing back from the compressor to the evaporator when the compressor stops; and a control unit controlling the compressor and the first valve, said control unit opening and closing the first valve in response to the operation and stopping of the compressor so that opening of the first valve occurs before the compressor is stopped.

* * * * *